US006576039B2

(12) United States Patent
Koffron et al.

(10) Patent No.: US 6,576,039 B2
(45) Date of Patent: Jun. 10, 2003

(54) METHOD AND APPARATUS FOR METAL POURING

(75) Inventors: Robert J. Koffron, Farmington Hills, MI (US); Jeffrey Jacobs, Farmington Hills, MI (US)

(73) Assignee: Tetron, Inc., Farmington Hills, MI (US)

( * ) Notice: Subject to any disclaimer, the term of this patent is extended or adjusted under 35 U.S.C. 154(b) by 13 days.

(21) Appl. No.: 09/897,208

(22) Filed: Jul. 2, 2001

(65) Prior Publication Data

US 2003/0004602 A1 Jan. 2, 2003

(51) Int. Cl.[7] ..... C21C 10/04

(52) U.S. Cl. ..... 75/375; 266/45; 266/80; 266/90; 266/236

(58) Field of Search ..... 75/375; 266/45, 266/80, 90, 236

(56) References Cited

U.S. PATENT DOCUMENTS 4,431,169 A 2/1984 Fuzii et al.
4,718,644 A 1/1988 Hoffman et al.
4,799,650 A 1/1989 Labate
5,044,610 A 9/1991 Koffron
5,203,909 A 4/1993 Petrushka et al.
6,074,598 A 6/2000 Koffron et al.
6,280,499 B1 * 8/2001 Koffron ..... 75/375

* cited by examiner

*Primary Examiner*—Melvyn Andrews
(74) *Attorney, Agent, or Firm*—Brooks & Kushman P.C.

(57) ABSTRACT

A method and apparatus is disclosed to improve the metal yield by adjusting the tilt angle of a tilting vessel having a submerged tap hole. The tilt angle is adjusted in response to parameters inherent in the pouring process, i.e. the proximity of the vessel contents to the vessel lip, the age of the tap hole, the liquid head over the tap hole, etc. Additionally, methods are disclosed to enhance the metal yield by advancing or moving back the furnace without knowledge of the tilt angle. Moreover, such methods and apparatus can be implemented through the use of computer based algorithms. The methods can also be used to archive pouring parameter information for future uses such as training and reviewing.

28 Claims, 3 Drawing Sheets

METHOD AND APPARATUS FOR METAL POURING

BACKGROUND OF THE INVENTION

1. Field of the Invention

The present invention relates to a method and apparatus for pouring metal by a method and apparatus for improving the discharge performance of metal pouring vessels by adjusting vessel tilt.

2. Background Art

Attempts have been made to improve the performance of tilting vessels having a submerged tap hole by minimizing slag entrainment. One such attempt calls for tilting the furnace on its pivot or trunnion and decanting the lighter slag from the steel at the lip of the furnace. This method is disadvantageous since the slag and molten metal corrode the refractory lining along the lip of the furnace. Additionally, it is inefficient and wastes metal because decanting most of the slag without carrying over some molten metal is highly difficult, if not impossible. In U.S. Pat. No. 4,431,169 a boom-mounted, elongated stopper is inserted over the tap hole and lowered to constrict the pour when the amount of liquid metal remaining is low. Subsequently, the boom is slightly raised to allow a slow metal pour without creating vortexes. This method requires expensive control equipment. Moreover, placing the stopper directly over the tap hole presents a great difficulty because the tap hole cannot be seen by the operator. In U.S. Pat. No. 5,203,909 a lance is inserted in the furnace above the surface of the slag and provides a pressurized jet of inert gas which blows the slag away from the tap hole. Correct positioning of the lance of maximum effect is difficult, complicated and expensive. Moreover, the use of large amounts of costly inert gases are required.

Other slag entrainment controls include apparatus of U.S. Pat. No. 4,799,650 a closure having a higher specific gravity than slag but lower than steel has an elongated hexahedral extension which acts as a vortex inhibitor. At a liquid metal level determined by the geometry and density of the device, the hexahedral extension enters and obstructs the tap hole, preventing any further pouring. Problematically, this device is prone to flip sideways, allowing the extension to pass by the tap hole without obstructing the flow. Additionally, not only is a substantial amount of steel retained in the furnace when the closure enters the tap hole, but also the closure is difficult to remove from the tap hole. As taught in U.S. Pat. No. 5,044,610 a device having a tetrahedral shape without the elongated extension is a distinct improvement. This device retracts vortex formation, and increases the amount of metal poured before obstruction of the tap hole. However, some slag may still be entrained.

In U.S. Pat. No. 4,718,644 a slag sensor is mounted on a non-ferromagnetic tap hole nozzle. The sensor detects the flow of slag by measuring eddy currents and magnetic fields in the material flowing through the nozzle. Problematically, the sensor does not detect the first presence of slag in the output stream. The proportion of slag in the output stream must increase to a substantial amount before detection. By this point, a significant amount of slag has already passed through the tap hole. A method disclosed in U.S. Pat. No. 6,074,598 improves the accuracy of detecting the initiation of slag contamination in the metal flowing through a tap hole. The method calls for inhibiting the formation of a vortex over the discharge opening in order to reduce the turbulence of flow directly above the tap hole, and limits the premature entry of slag into the tap hole and allows a slag sensor to more easily identify the steel to slag transition.

Another slag separation control is disclosed in U.S. patent application Ser. No. 08/665,992, where a method is disclosed for improving metal pouring by tilting, side-tapping surface. The method provides an optimum tilt angle for pouring determined by the amount of metal residuum, the furnace geometry, and the history of wear in the furnace. The optimum angle is the angle within the critical tilt range which is capable of supplying liquid metal through the tap hole with minimal vortex formation and minimal slag entrainment for any given amount of metal residuum. The critical tilt range is the range on either side of the tilt angle for any given furnace design wherein the tap hole is lowest with respect to gravity. The method increases slag separation as a function of the metal residuum (the amount of metal remaining in the furnace toward the end of the pour) and physical furnace features.

SUMMARY OF THE INVENTION

The present invention overcomes the above-mentioned disadvantages by a method and apparatus for improving metal pouring by further increasing the response of the tilt control while maintaining the slag separation in a metal pouring tilting vessel having a submerged tap hole. In general, a selected set of pouring parameters is determined from a group. The pouring parameters include, but are not limited to, the age of the tap hole, the proximity of the charge to the lip of the vessel, the lining geometry of the vessel, the presence of vortexing, and the liquid head over the tap hole. A condition input is received for each pouring parameter selected and the process permits additional tilt control based on the condition input. The tilt angle of the vessel is adjusted to increase the metal yield, including quality and purity, by maximizing the amount of the liquid bath over the tap hole, and thereby maximizing the throughput of liquid metal through the tap hole and maximizing steel/slag separation. The adjustment also limits uncontrolled discharge from the vessel lip.

Another advantage of the present invention is a method to improve metal yield, quality and purity, of a tilting vessel having a submerged tap hole by determining the proximity of the vessel contents to the vessel lip. In response to this determination, the tilt angle of the tilting vessel is adjusted to increase the metal yield, and thereby maximizing the flow rate of liquid metal through the tap hole and maximizing slag separation. The adjustment also limits uncontrolled discharge from the furnace lip.

An additional advantage of the present invention is a method to improve metal yield of a tilting vessel having a submerged tap hole by determining the age of the tap hole of the tilting vessel. The age of the tap hole can be ascertained by a value stored in computer memory or by means of a mechanical counter. The tilt angle of the tilting vessel is adjusted according to the age of the tap hole to increase the metal yield, and thereby maximizing the flow rate of liquid metal through the tap hole and maximizing slag separation. The adjustment also helps limit uncontrolled slag discharge from the vessel lip.

Yet another advantage of the present invention is a method to improve metal yield of a tilting vessel having a submerged tap hole by determining the tapping trajectory from at least one historical pour. The flight path is a diagram that tracks the tilt angle of the furnace as a function of tapping time. The tilt angle of the tilting vessel is adjusted based on the flight path of at least one historical pour to increase the metal yield, and thereby maximizing the throughput of liquid metal through the tap hole and maximizing slag separation. The adjustment also limits uncontrolled discharge from the furnace lip.

A further advantage of the present invention is a method for determining a final drain angle for a tilting vessel having a submerged tap hole. The method calls for measuring the lining geometry of a tilting vessel. The final drain angle is then determined based on the measured inner geometry. The inner geometry can be measured visually or by a laser recognition device.

Yet a further advantage of the present invention is a method for determining a critical height of vortexing for a tilting vessel having a submerged tap hole. The method first determines the inner geometry of a tilting vessel, the amount of metal discharged into the second vessel, the amount charged to the tilting vessel, and the volume of the vessel contents. Thereafter, the critical height of vortexing is determined based on the volume of the vessel contents (determined from the metal discharged and the amount charged) and the inner geometry of the vessel.

Still another advantage of the present invention is a method for determining the heel weight of a closed tilting vessel having a submerged tap hole and giving the operator the ability to control it. The method first determines the amount of metal discharged into the second vessel, the amount of the vessel charge, the amount of the vessel contents, and the temperature of the vessel contents. Based on the temperature of the vessel contents and the amount of the vessel contents (determined from the metal discharged and the amount charged), the heel weight can be determined and subsequently managed.

Moreover, an added advantage of the present invention is a computer-implemented method for improving metal yield by adjusting the tilt angle of a tilting vessel having a submerged tap hole. In general, a selected set of pouring parameters is generated by user input. The pouring parameters include, but are not limited to, the age of the tap hole, the proximity of the charge to the vessel lip, the lining geometry of the tilting furnace, and the liquid head over the tap hole. A condition input is received for each pouring parameter selected and the process permits additional tilt control based on the condition input. The tilt angle of the furnace is adjusted to increase the metal yield, including quality and purity, by maximizing the amount of the liquid bath over the tap hole, and thereby maximizing the throughput of liquid metal through the tap hole and maximizing slag separation. The adjustment also limits uncontrolled discharge from the furnace lip.

Still yet another advantage of the present invention is a process for improving metal yield without the measurement of a tilt angle. A vessel worker adjusts the tilt angle no matter what the current angle is, based on a pouring parameter, such as, but not limited to the proximity of the vessel contents to the vessel lip, the presence of vortexing or the presence of slag in the tapping stream.

DETAILED DESCRIPTION OF THE PREFERRED EMBODIMENTS

The method and apparatus of the instant invention are suitable for tilting vessels having a submerged tap hole and pouring into a second vessel. The term submerged tap hole contemplates both side-tapping vessels and bottom-tapping vessels. Both types of vessels are generally constructed of steel and are lined with refractory material. However, non-lined vessels may be satisfactory.

Figure 1:
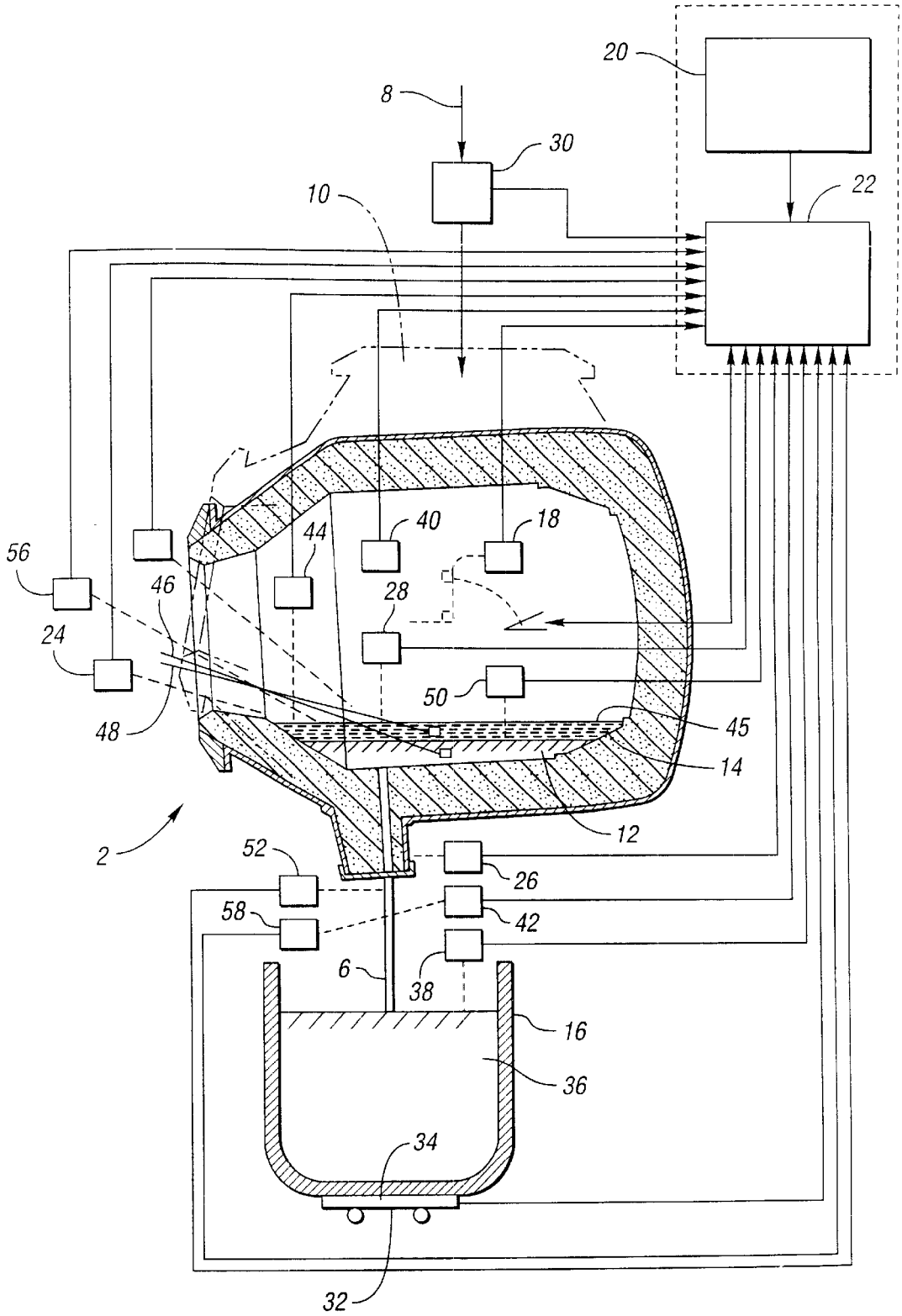
FIG. 1 is a schematic drawing of a basic oxygen furnace and a flow diagram utilizing the apparatus and process of the disclosed invention.

FIG. 1 depicts a side-tapping vessel that can be utilized with the present invention. Side-tapping vessel 2 has side tap hole 4 located on the side of the vessel 2 through which molten metal exits tapping stream 6 as vessel 2 is tilted. A particular example of a side-tapping vessel is the basic oxygen furnace, otherwise referred to as the BOF. BOFs are charged with mixture 8 of scrap steel, liquid iron, lime-based fluxes and other ingredients through open mouth 10 of the BOF. Highly pressurized and purified oxygen melts mixture 8 into a substantially liquified state. The melted constituents form two layers: liquid metal layer 12 and slag layer 14. The vessel 2 is tilted in order to pour liquid metal 12 through side tap hole 4 and into second vessel 16.

Figure 2:
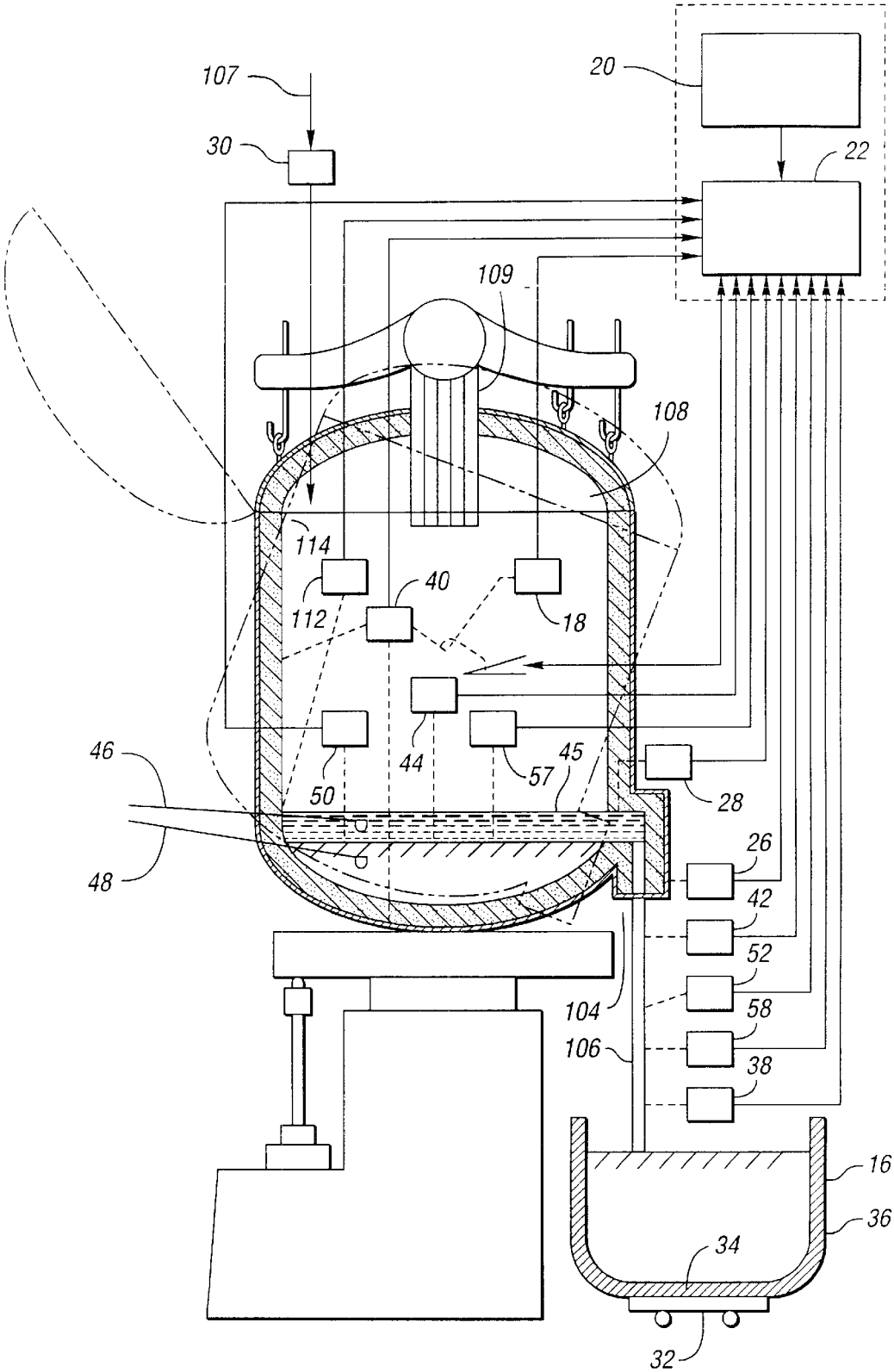
FIG. 2 is a schematic drawing of a eccentric bottom tapping furnace and a flow diagram utilizing the apparatus and process of the disclosed invention.

Looking at FIG. 2, bottom-tapping vessel 102 has bottom tap hole 104 located on the bottom of the vessel 102 through which molten metal exits tapping stream 106 as bottom-tapping vessel 102 is tilted. A specific example of a bottom-tapping vessel is the eccentric bottom tapping furnace, otherwise referred to in the field of art as the EBT. The EBT operates by heating scrap metal with graphite electrodes 109. Unlike the BOF's open mouth configuration, the EBT has an enclosed roof 108 at its top. During operation of the EBT, the roof and the electrodes are raised and a bucket of scrap metal 107 is delivered to the furnace by a scrap charging crane. Once the EBT is charged, enclosed roof 108 and graphite electrodes 109 are lowered into place over the furnace. The electrodes 109 strike an arc over the scrap and thereby heating metal scrap 107. Once the heated scrap is of desired composition and temperature, the bottom tap hole 104 is opened, the furnace is tilted, and liquid steel exits into tapping stream 106 into second vessel 110.

According to the present invention, a method and apparatus are disclosed for improving the yield of metal poured through a submerged tap hole from a tilting vessel, such as a BOF or EBT, into a second vessel by adjusting a tilt angle of the tilting vessel. Metal yield is improved by at least improving the quality of the metal produced or by increasing the amount of metal produced as a function of the amount charged to the tilting vessel. The metal yield is improved by maximizing the amount of liquid head over the tap hole. The maximum amount of liquid head over the tap hole is defined as the amount of liquid head that maximizes the flow of metal through the tap hole and that maximizes the separation of slag and liquid metal by suppressing vortexing, while limiting uncontrolled discharge over the vessel lip or coating the back wall or roof with slag, in the case of an EBT.

The current method and apparatus may also decrease operator error, and allow for repeatable performance with positive results, thus resulting in an improvement in metal yield. Operator error is reduced by keeping him/her alert during the pouring process and by providing the operator with a recommended tilt edge. The method could reduce the amount of bath spillage over the lip of an open-mouth tilting vessel. Such spillage is costly in many ways. The spillage could damage the ladle, the teaming car or other equipment that is located below the tilting vessel lip. Additionally, the spilled bath decreases the amount of metal produced during the pour. Moreover, the spilled bath contains slag that may spill over into the ladle and contaminate the liquid metal already tapped. The currently disclosed method also allows the operator to focus on the pouring process by providing real-time information on the pouring parameters. For example, the operator could be provided with information pertinent to whether slag has been entrained in the tapping stream. With this information readily available, the operator can shut down the pour before substantial contamination occurs, and additionally the operator can properly advance or move back the tilting vessel to prevent low head vortexing. In other words, the method provides operators with real-time information in order to make accurate decisions, thus providing the operator with an expert guidance method.

Referring to FIGS. 1 and 2, an initial step in the process is measuring the tilt angle of the vessel during the discharge of liquid metal from the tap hole 4 or 104. Generally known tilt angle measuring devices 18 include, but are not limited to, rotary variable capacitance sensors, inductive sensors, and DC servo motor sensors. Preferably, device 18 used should be capable of measuring the tilt angle within plus or minus one degree. More preferably, the device used should be capable of measuring the tilt angle within plus or minus one-half degree. Most preferably, the measuring device should be able to measure the tilt angle within plus or minus one tenth degree. The tilt angle may be presented in an analog manner or more preferably in the form of a digital output or readout.

Referring to FIGS. 1 and 2, as the next step in the process, determination 20 of a selected set of pouring parameters is made. Determination 20 can be made by an individual with knowledge particular in the field of art or by a computer algorithm or any other suitable implement. Preferably, a vessel operator, a vessel melter or vessel superintendent determines the selected set of pouring parameters. Based on historical choices and user input, a computer algorithm can be implemented on a semi-automated or fully automated level in order to determine the selected set of pouring parameters. The selected set includes at least two parameters, but it can contain more. The pouring parameters are selected to improve the metal yield of a tilting vessel based on the metal pouring operation at a particular steel plant. A pouring parameter is any piece of information generated as a result of processing metal in a tilting vessel with a submerged tap hole. A representative and comprehensive, although not exhaustive list of pouring parameters includes, but is not limited to the following: the proximity of the vessel contents to the vessel lip, the age of the tap hole, the amount of slag in the tilting vessel, the amount of a vessel charge, the amount of metal discharged into the second vessel, the amount of the tilting vessel contents, the inner geometry of the tilting vessel, the presence of slag in the tap hole, the liquid head over the tap hole, the tapping trajectory from at least one historical pour, the total tapping time from at least one historical pour, the elapsed discharge time, the critical height of vortexing, the final drain angle, the steel grade, the steel chemistry, the temperature of the vessel contents, the rate of liquid metal flowing through the tap hole, and the presence of vortexes.

Once a selected set of pouring parameters is determined, a condition input for each pouring parameter in the selected set of pouring parameters is received by input device 22. A condition input is information corresponding to the state of the pouring parameter. The condition input may be a quantitative value, i.e. the amount of a vessel charge or the age of the tap hole. The condition input may also be a qualitative value, i.e. the proximity of the tilting vessel contents to the vessel lip as evaluated by a vessel operator. Condition input is used to adjust the tilt angle of the tilting vessel in order to improve the metal yield. Depending on the pouring parameter, condition input can be received from various sources. For example, a vessel operator or melter can visually inspect the contents of tilting vessel for the presence of vortexes. Additionally, sensors can be used to provide the condition input for each pouring parameter. Moreover, condition input can be received manually by the vessel operator or other vessel worker.

The proximity of the contents of the tilting vessel to the lip of the tilting vessel can be measured by various measuring devices 24. A video camera can capture a view of the vessel lip and output this view to a video monitor. The vessel operator, melter, superintendent or other trained personnel examines the video output and judges the approximate proximity of the vessel contents to the lip of the vessel. Alternatively, a microwave sensor sends microwaves in the direction of the contents of the vessel in proximity to the vessel lip. The hot surface of the vessel contents reflect the microwaves. The reflected microwaves are converted then to a distance measurement. Likewise, infrared sensors or thermal recognition sensors, similar in method and effect as the microwave sensors, can be utilized to measure the distance of the vessel contents to the vessel lip. Conductive probe sensors may be lowered onto the surface of the vessel contents nearest to the vessel lip. The onset of conductivity is used to trigger an electrical circuit which calculates height based on the position of the sensor from a reference point. Likewise, hall-effect, capacitance, and inductive sensors, similar in operation and effect as the conductive probe sensor may be utilized. The melter, or any other capable steel vessel worker, can visually inspect the proximity of the contents to the vessel lip.

Pertaining to closed tilting vessels, the proximity of the tilting vessel contents to edge 114 of various measuring devices back wall 116 of the bottom-tapping vessel 102 can be computed using various measuring devices 112. Enclosed roof 108 of bottom-tapping vessel 102 can be fitted with a video camera that captures a view of the back wall edge 114. In addition, microwave, infrared or vision sensors can be affixed to enclosed roof 108 and used to determine the proximity of the vessel contents to back wall edge 114. However, since the contents of closed tilting vessel 102 are not visible to the naked eye during the pouring process, the melter, or any other capable steel vessel worker, cannot visually inspect the proximity. Further, the roof can be removed during tapping for a number of heats to create a base line for future estimates.

Various measuring devices 26 may be used to determine the age of tap hole 4 or 104. The age of the tap hole refers to the number of pours in which tap hole 4 has been through since installation. A mechanical counter can be installed with a reset capability. Once a new tap hole is installed, the mechanical counter is reset to zero. At the beginning of each new tap, the mechanical counter value is increased by one. The change in the value of the mechanical counter can be made by a steel worker, i.e. the counter can be set to respond to a button that is pushed at the beginning of each pour. Alternatively, a sensor can be installed that detects the beginning of each pour. Once the sensor detects the occurrence of a new pour, the mechanical counter value is automatically increased by one. Additionally, a steel mill's computer network can be used to ascertain the age of the tap hole. In most steel mills, the installation of a new tap hole is recorded on the steel mill's computer database. Subsequently, each pour is recorded in the same database, either by user entry or an automated system that uses pour sensors linked to the database. Thereafter, a vessel worker can refer to this information to determine the number of pours in which the current tap hole has gone through. Manual recording is yet another way in which the age of the tap hole can be determined. For example, a steel worker can utilize a hand counter that is advanced at the beginning of each pour. Alternatively, a notebook can be used to record the number of pours in which the current tap hole has been utilized.

The amount of slag in the tilting vessel can be determined by various measuring devices 44. The amount of slag is a function of slag height 45 in the tilting vessel and the inner geometry of the tilting vessel. A variety of non-contacting sensors may be used to calculate slag height 45, such as microwave sensors, infrared sensors or vision sensors. By using slag height 45 and the inner geometry, the determination of the amount of slag can be accomplished by one skilled in geometry. Preferably, by use of a CAD/CAM computer program, the amount of slag in the tilting vessel can be determined automatically.

The amount charged to the tilting vessel can be determined by various measuring devices 30. The amount charged is a function of the components fed to the vessel. As previously discussed, these components include pig iron, scrap metal, fluxing agents and other ingredients. These components can be weighed before being introduced into the tilting vessel. The sum of the component weights is an estimate of the weight of the contents charged to the tilting vessel. In order to determine the volume, the amounts of the various charges of slag forming ingredients, scrap steel, and pig iron are inputted into a computer database and used to either calculate or determine, from a look-up table, the volume of the charged contents.

The amount of metal discharged into second vessel 16 can be determined through various methods. For example, teaming car 32 on which the second vessel 16 sits may be provided with scale or load cell 34 and tared prior to the pour. As the metal pour proceeds, the weight of the second vessel less its tare weight provides the amount of metal discharged 36 into the second vessel. Alternatively, discharged metal 36 in second vessel 16 may be viewed with a video camera 38 and the image compared to stored images using procedures similar to those used in conventional image recognition techniques. In addition, the amount of metal discharged into second vessel 16 can be determined as a function of other pouring parameters. For example, the amount of metal discharged is the value of the amount charged to the tilting vessel less the amount remaining in the tilting vessel. By illustration of another example, the elapsed discharge time (unit of time) multiplied by throughput of liquid metal exiting the tap hole (weight or volume of liquid metal per unit time) is the amount of metal discharged.

The inner geometry of tilting vessel 2 or 102 can be determined by various measuring devices 40. The inner geometry refers to the three dimensional shape of the lining of the tilting vessel, including divots and pockets. The vessel volume can be computed from the inner geometry of the tilting vessel. Preferably, laser readings are utilized to determine the inner geometry. A typical laser reading 406 is provided in FIG. 4. Laser reading 406 provides a cross sectional view along the length of the tilting vessel at different points along the width of the tilting vessel. The cross sectional view contains tilting vessel outline 401 and contoured curve 410 depicting the vessel lining along the length of the tilting vessel at the tap hole. The contoured curve 410 reveals divots and pockets in the tilting vessel lining due to usage and wear. Due to the build up of refractory material in the tilting vessel during subsequent pours, contoured curve 410, and thus the inner geometry of the tilting vessel changes after every pour. In order to determine the three dimensional inner geometry of the tilting vessel, cross sectional laser readings are taken at different points along the width of the tilting vessel and the resulting data can be used to construct a three dimensional model of the inner geometry of the tilting vessel lining. Alternatively, a vessel worker can visually inspect the vessel lining in order to estimate the inner geometry.

The presence of slag in tapping stream 6 can be determined by using various measuring devices 42. For example, an electromagnetic sensor based on eddy currents which differentiate between materials with low and high electrical conductivity can be utilized. The eddy current produced by the sensor can be used to detect the absence of slag in the tapping stream. At the point in time during the pour in which slag starts escaping the tap hole, the eddy current changes, thus signaling the presence of slag. In addition, microwave, infrared or vision sensors can focus on tapping stream 6 and calibrated to signal the presence of slag. Alternatively, video camera can output a view of the tapping stream to a vessel worker, who can determine the presence of slag in tapping stream 6. Likewise, a vessel worker can visually inspect tapping stream 6 for the presence of slag.

The liquid head over the tap hole can be measured by various measuring devices 28. A video camera can capture a view of the liquid head directly above tap hole 4 and output this view to a video monitor. The vessel operator, melter, superintendent or other trained personnel examines the video output and judges the height of the liquid over the tap hole. Alternatively, a microwave sensor sends microwaves in the direction of the liquid head over the tap hole. The hot surface of the tilting vessel contents reflect the microwaves. The reflected microwaves are converted then to a distance measurement. Infrared sensors, similar in method and effect as the microwave sensors, can be utilized to measure the height of the liquid head over the tap hole. Alternatively, a vessel worker can qualitatively assess the height of the liquid head by visually inspecting the tilting vessel contents. Additionally, image sensors linked to a computer program can measure the liquid head over the tap hole.

Figure 3:
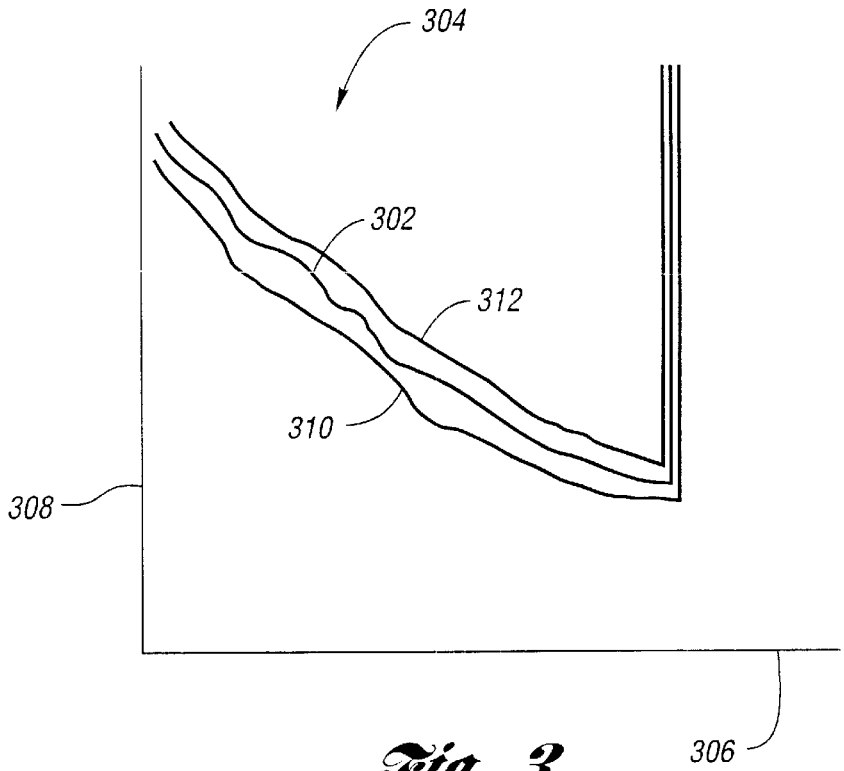
FIG. 3 is a diagram depicting a tapping trajectory as disclosed in the present invention.

Referring now to FIG. 3, tapping trajectory 302 from at least one historical pour can be measured by methods similar to those used to measure the tilt angle. Tapping trajectory 302 refers to diagram 304 that represents the variation in the tapping angle as a function of tapping time. Generally known devices for measuring the tilt angle include, but are not limited to, rotary variable capacitance sensors, inductive sensors, and DC servo motor sensor. The tilt angle of produced by these measuring devices can be fed to a computer database that records the tilt angle as a function of the elapsed time of the pour. Alternatively, the outputted tilt angle and the elapsed time of the pour can be recorded manually by a vessel worker. Once the data is recorded, the tilt angle can be plotted as a function of elapsed tap time, thus producing tapping trajectory 302. Tapping trajectory 302 can be constructed using a computer or can be manually constructed by an individual with knowledge of basic algebra. Predicted tapping trajectory 304 guides the vessel operators tilt angle adjustments. Tapping trajectory 304 refers to a diagram that represents the variation in the tapping angle as a function of tapping time. The tapping trajectory is determined by the archived condition input for each pouring parameter in said selected set of pouring parameters. The tapping trajectory can also take into account current tapping conditions and pouring parameters. The vessel operator is provided with an approximate tapping angle based real-time information. X-axis 306 of the tapping trajectory tracks the elapsed tapping time and y-axis 308 represents the tapping angle as a function of the elapsed tapping time. With this information and knowledge of the elapsed tap time of the current pour, the operator can estimate the approximate tap angle necessary to improve metal yield. Along with the predicted tapping trajectory 304, standard deviation curves 310 and 312 are also provided above and below the predicted flight path, signifying one standard deviation plus and minus. Deviation curves 310 and 312 supply the vessel operator with tilt angle boundaries or a range within in which the tilt angle should be kept during pouring.

The elapsed discharge time and the total tapping time from at least one historical pour can be measured by various methods. Preferably, a timer is utilized that is electronically connected to the steel mill's computer database. The timer is reset at the beginning of every pour and starts once pouring begins. The elapsed time, as calculated by the timer is sent to the steel mill's computer database. Before resetting the timer, the total tapping time from the preceding pour is recorded in the steel mill's computer database. Alternatively, a vessel worker can use timer that is manually started, stopped and reset. The resulting tapping times can be recorded on paper or input into a computer database.

The critical height of vortexing is determined by a preferred method of the present invention. The critical height of vortexing is defined as the maximum height of liquid bath over the tap hole in which vortexes begin to form. The vortexes suck slag from slag layer 14 into the liquid metal 12 over tap hole 4 or 14. The mixture of slag and liquid metal then enters tapping stream 106 and is poured into second vessel 16. The entrained slag adversely effects the quality of the liquid metal poured from the tilting vessel. The critical height of vortexing has been determined to be a function of the inner geometry of the tilting vessel, the amount of metal discharged into the second vessel, and the amount charged to the tilting vessel and age and size of the tap hole. Primarily, the method calls for determining the inner geometry, the amount of metal discharged and the amount charged to the tilting vessel. As an intermediate step in the method, the volume of the vessel contents is determined by subtracting the volume of the metal discharged into the second vessel from the amount charged to the tilting vessel. The final step in the method is determining the critical height of vortexing based on the volume of the vessel contents and the inner geometry. It is understood that this method can be carried out by a computer algorithm during the pouring process or by calculations manually made by a vessel worker.

Figure 4:
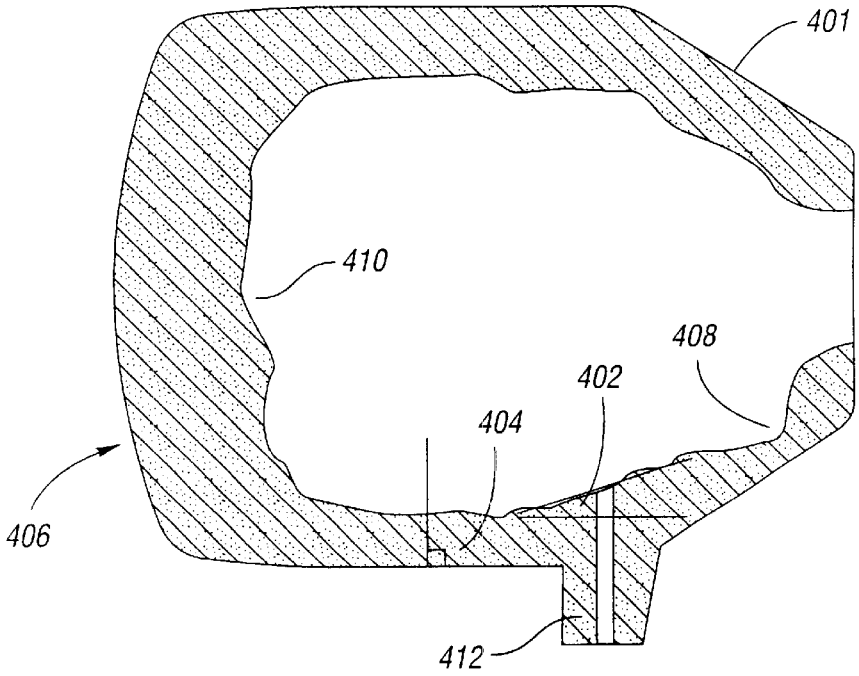
FIG. 4 is representative graphical laser reading of a contour curve of the inner geometry of a tilting vessel.

The final drain angle is determined by a preferred method of the present invention. The final drain angle is defined as the tilt angle of the tilting vessel at the end of a metal pour. Furthermore, achieving the final drain angle by the end of the pour increases the amount of liquid metal poured from the tilting vessel by ensuring that liquid metal captured in reservoirs in the vessel lining are poured through the tap hole. With reference to FIG. 4, the final drain angle is a function of furnace neutral angle 404, normally recognized drainage angle, lining contour angle 402 and compensation angle based on lining abnormalities. In the case of a BOF, furnace neutral angle 404 refers to the angle of tilting vessel 406 when the side of tilting vessel 406 is parallel to the ground. Depending on the point of reference, this angle is either 90 or 270 degrees. Normally recognized drainage angle refers to that angle necessary to induce a movement of reservoir or pool of molten metal 408 from its position towards tap hole 412. Lining contour angle 402 refers to the angle relative to the furnace neutral angle 404 roughly tracking the contour of vessel lining 410 at the cross section of the tilting vessel length at tap hole 412. Compensation angle refers to the angle necessary to induce a movement of molten metal contained in divots or ditches of the vessel lining towards tap hole 412.

The preferred method for determining the final drain angle includes measuring the lining geometry of the tilting vessel and determining the final drain angle based on the lining geometry. The lining contour angle and the compensation angle is determined from the lining geometry. Preferably, the lining geometry is provided by laser readings. The final drain angle is then determined by the sum of the furnace neutral angle, a normally recognized drainage angle, a lining contour angle and a compensation angle based on lining abnormalities. For example, the furnace neutral angle could be 90 degrees, the normally recognized drainage angle can be in the range of 3–8 degrees, the lining contour angle could be measured as −5 to +5 degrees and the compensation angle could be 1–5 degrees. Inputting these values into the determination, the final drain angle would be 106 degrees. It is understood that this computation can be made by a vessel worker or by a computer algorithm.

The steel grade is preferably input by a vessel worker or found by referring to the steel mill's computer database. The steel grade depends upon the type of steel requested by the customer. As such, these values are available in the steel mill's computer database along with other customer information such as billing address, amount of steel ordered, outstanding balance, contact information, etc.

The steel and slag chemistry can be measured by various methods. Steel chemistry refers to the composition and physical properties of the liquid metal contained within the tilting vessel after the initial charge is heated. Physical properties of the liquid metal include, but are not limited to, viscosity, density and temperature. Composition of the liquid metal refers to the chemical makeup of liquid metal in terms of its different constituents or components. For example, a certain liquid metal composition may include a weight or volume percentage of carbon and saturated gases, as well as other components. Slag chemistry refers to the composition and physical properties of the slag layer contained within the within the tilting vessel after the initial charge is heated. Physical properties of the slag include, but are not limited to, viscosity, density and temperature. Composition of the slag refers to the chemical makeup of the slag in terms of its different constituents. An exemplar slag mixture may contain certain weight percentages of silicon oxide, aluminum oxide, calcium oxide, magnesium oxide, or potassium oxide.

Charge models are used to estimate the steel and slag chemistry in the charge and to control the final steel and slag chemistry. A charge model determines the best mix of inputs to use for the desired steel grade in order meet quality standards for steel chemistry and slag chemistry. The best mix of lime-based fluxes, pig iron, iron scrap and other ingredients is recorded by the charge model. Once this mix is charged, blended and heated, the charge model predicts, with a fair amount of certainty, the steel and slag chemistry, including the weight percentages of all constituents or components. Alternatively, an actual sample of the liquid metal or slag in the liquid bath of the tilting vessel can be analyzed. For example, scoop 46 or 48 can be dipped into either liquid metal layer 12 or slag layer 14 to extract a sample. The sample is then inserted into a spectroscopy machine in order to analyze the chemistries of the steel and slag. Such spectroscopy machines can be used for on-site analysis that usually takes between three to five minutes. Alternatively, the sample is transported to an off-site laboratory for analysis.

The temperature of the tilting vessel contents can be measured by various temperature sensor probes 56. Generally, thermocouples, resistance temperature detectors (RTDs), thermistors, and infrared devices suitable for harsh conditions may be utilized. Thermocouples produce a continuous current flow that is measured by a voltmeter or other device. The voltmeter interprets the voltage reading as a temperature value. RTDs equate the change in the resistance of the probe wiring with a change in temperature. Like the RTDs, thermistors run on similar principles, but are more sensitive to temperature changes. Infrared devices detect the infrared energy given off by materials. A common design includes a lens to focus the infrared energy onto a detector. The amount of infrared energy is then converted into a temperature measurement in suitable units.

The throughput of liquid metal exiting tap hole 4 or 104 can be measured by various measuring devices 52. Preferably, an electromagnetic sensor is placed within the vicinity of tapping stream 6. Most preferably, this throughput is measured by placing a scale on the teaming car. The scale weighs the contents of the ladle. The throughput is then computed by knowing the weight, the elapsed discharge time, and the size of the tap hole. Such a sensor provides output that can be mathematically converted into a throughput value in units of volume per unit time. Alternatively, vision sensors can produce the same results using similar methods.

The presence of vortexes can be measured by various measuring devices 57. Two types of vortexes generally form in a tilting vessel, low head vortexing and critical height. Critical height vortexing occurs when the volume of the contents of the tilting vessel is less than the minimum volume used to create a liquid head over the tap hole to surpass the critical height to prevent vortexing. This phenomena usually occurs during the later stages of tapping. Low head vortexing occurs when the level of liquid bath over the tap hole reaches the critical height of vortexing even though there is ample liquid bath in the tilting vessel to overcome the critical height. Low head vortexing is sometimes referred to as "sucking slag." This phenomena generally occurs because the operator has not properly advanced the tilting vessel in a timely manner. Detecting the presence of low head vortexing gives the vessel operator the opportunity to correct an improper movement in the tilt angle. A video camera can capture a view of the surface of the tilting vessel contents and output this view to a video monitor. A vessel worker examines the video output for swirls and other distortions in the liquid surface which indicate the formation of vortexes. Alternatively, a vessel worker can visually inspect the bath surface for such indicators of vortex formation. Additionally, other pouring parameters can indicate the presence of vortexes. These parameters include, but are not limited to, the distortion of the tapping stream, the volume of the contents of the tiling vessel, the rise or age of the tap hole, the tilt angle, and the presence of slag in the tapping stream.

The distortion of the tapping stream can be measured by many different measuring devices 58. For example, an electromagnetic sensor based on eddy currents which differentiate between materials with low and high electrical conductivity can be utilized. The eddy current produced by the sensor can be used to detect the absence of distortion in tapping stream 6. At the point in time in which distortion starts occurring, the eddy current changes, thus signaling the presence of distortion. In addition, microwave, infrared or vision sensors can focus on tapping stream 6 and calibrated to signal the presence of distortion. Alternatively, video camera can output a view of tapping stream 6 to a vessel worker, who can determine the presence of distortion in the tapping stream. Likewise, a vessel worker can visually inspect tapping stream 6 for the presence of distortion.

Pertaining to closed tilting vessels, the heel weight can be determined by a method embodied in the current invention. The heel weight refers to the amount of liquid bath remaining in a closed tilting vessel after the pour is stopped. The heel facilitates melting the next charge by enhancing the electrical current flowing through the vessel by having a liquid pool as a zone where the electrical current can readily pass through. The heel is necessary to heat the next charge that is fed into the closed vessel. Therefore, the heel must contain enough thermal energy to facilitate the melting of the next batch of raw materials, which can include scrap iron, scrap steel, fluxes and other ingredients. The heel weight is chosen by a vessel operator or the computer database based on the amount of heat necessary. According to the present invention, the pouring process in a closed tilting vessel can be controlled to deliver the heel with the necessary heat characteristics, and desired residual volume.

In a preferred method of the current invention, the heel weight can be determined by first determining the amount of metal discharged into the second vessel, then determining the amount of the closed tilting vessel contents based on the amount of metal discharged into the second vessel, and then determining the heel weight based the amount of said closed tilting vessel contents. The amount of said closed tilting vessel contents is computed by subtracting the amount of metal discharged from the amount charged to the closed tilting vessel. Alternatively, the closed tilting vessel contents can be determined by multiplying the liquid metal throughput by the elapsed tap time and subtracting this value from the total amount charged to the closed tilting vessel. With knowledge of the calculated heel weight, subsequent charges can be varied to accommodate deviations from the ideal heel weight.

After the condition input is received for each pouring parameter in said selected set of pouring parameters, the tilt angle of the tilting vessel is adjusted in response to each condition input of said selected set of pouring parameters. In other words, the tilt angle is adjusted as a function of the condition inputs to improve the metal yield by increasing the amount of liquid head over the tap hole without slag spillover and increasing throughput without slag entrainment. The adjustment can be exacted by a vessel worker, such as a vessel operator, melter or superintendent using his/her judgment or by an automated system using a computer algorithm. The vessel operator is provided with a recommended tilt angle based on the condition input of each pouring parameter during the vessel pour. The recommended tilt angle is updated as the condition input changes as the pour continues. Therefore, the operator is provided with an estimated tilt angle to maximize metal yield based on current taping conditions.

In one preferred process, the selected set of pouring parameters includes the total tapping time from at least one historical pour and the elapsed discharge time. During a typical run, the operator initiates the pour by tilting the vessel to a predetermined tilt angle, either indicated by a vessel worker or a computer database. Once the pour begins, the preferred process is activated. The tilt angle of the tilting vessel is measured while discharging liquid metal from the submerged tap hole into the second vessel. Measuring devices include, but are not limited to, rotary capacitance sensors, inductive sensors, and DC servo motor sensors. The output from the tilt sensor is mathematically converted into an angle measuring the tilt of the vessel. Preferably, the determined tilt angle is delivered to the vessel operator through an alphanumerical display, a light emitting diode display, or an analog gauge. In addition, the elapsed discharge time is measured by any known method, such as a manual timer or by a computer timer installed in the steel's mills network computer. The total tapping time from at least one historical pour can be determined by similar methods. The value can either be stored in a steel mill computer data base or be recorded on paper by the vessel operator.

According to this preferred method, all pouring parameter determinations are made without the necessity of an expensive computer system or expensive sensors. As a result, virtually any steel mill can implement the preferred process without great expense while still achieving improvement in metal yield. In practice, the vessel operator continuously monitors the tilt angle and the elapsed discharge time. Based on these variables and the total tapping time of at least one historical pour, the operator consults a simple table based on historical tapping data supplying a recommended tilt angle. The operator then adjusts the tilt of the vessel by manually activating the tilting mechanism until the tilt angle is approximately the same as the recommended tilt angle. Alternatively, an inexpensive stand-alone computer, with self-learning algorithms can be provided to increase the metal yield. Since the tilt angle is determined by the table, operator error is reduced by eliminating operator judgment.

In another preferred method, the vessel operator is provided with a computer monitor interface. The computer monitor interface provides the operator with important real-time tapping information at a processing location or locations. The processing location refers to a center where a vessel worker, including but not limited to a operator, melter, manager or superintendent, is providing with tapping information that allows the vessel worker to make better, well-informed tapping decisions. As a result, the metal yield of from the tilting vessel is improved, leading to appreciable cost savings. In one embodiment, the computer monitor interface can include the following information based on the condition input received from the following pouring parameters: the elapsed discharge time, the tilt angle, the predicted tapping trajectory, the estimated tapping duration, the proximity of the tilting vessel contents to the vessel lip, the presence of slag in the tapping stream, recommended and the final drain angle.

The estimated tapping duration also provides useful information that the operator can use to improve the metal yield. The estimated tapping duration is determined by the archived condition input for each pouring parameter in said selected set of pouring parameters. Along with the final drain angle value and the elapsed discharge time, the operator is provided with a target drain angle to be at by the end of the pour, as estimated by the estimated tapping duration.

The computer monitor is placed within the view of the vessel operator while he or she controls the tilt angle during the metal pour. The computer monitor provides the operator with real-time values of the pouring parameters before mentioned. Based on this information, the vessel operator adjusts the tilt of the vessel by manually activating the tilting means. Vessel operator judgment is enhanced greatly by having all this information at his or her fingertips. By using the method provided, an inexperienced vessel operator can become proficient in a very short period of time, as well as improving the skills of an experienced operator. The learning curve is decreased dramatically by using the computer monitor interface. Additionally, the computer monitor can contain different tapping views, that include, but are not limited to, a top view of the ladle, a side view of the tapping stream, and a view of the vessel lip.

In another preferred method of the current invention, computer algorithms are used in order to further improve the metal yield of a tilting vessel. The condition input from each and every pouring parameter can be archived within the persistent storage of a computer or in any other suitable means. This information can be reviewed by a vessel operator, a vessel superintendent and other steel workers in order to learn from past trends. This training capability can enhance the judgment of the vessel operator and in turn improve the metal yield. Likewise, a computer algorithm can be constructed to learn from the achieved condition input. Based on the values of the pouring parameters over time, the computer program can generate a tapping trajectory for the next pour. The algorithm can predict a recommended tapping trajectory based on the correlation of current pouring parameters with archived parameter values. For example, the current and achieved values of steel grade, steel chemistry and slag chemistry can be compared and the computer can predict a tapping trajectory based on the historical flight path used with the achieved values that are comparable to the current parameters. Computer-implemented algorithms used to carry out such predictions include, but are not limited to, a self-learning algorithm, a neural net or a fuzzy logic algorithm. Neural nets are computer programs that are capable of learning on their own and adapting to changed conditions. Fuzzy logic algorithms recognize more than just true and false values. As a result, propositions can be represents with degrees of falsehood and truthfulness. For example, pouring parameters can be assigned with degrees of importance. Based on these degrees, some parameters might play a bigger role in predicting a tapping trajectory for a subsequent pour.

A preferred method of the current invention is to improve metal yield from an EBT furnace. The EBT furnace does not have a vessel lip since the EBT furnace is closed during operation. Therefore, the proximity of the vessel contents to the edge of the back wall can be used as a pouring parameter, instead of the proximity of the vessel contents to the vessel lip. By minimizing the proximity of the vessel contents to the edge of the back wall, the liquid head over the tap hole increased. In addition, the preferred method will indicate to the operator when the vessel contents are dangerously close to the edge of the back wall, thus preventing the operator from throwing slag over the back wall and onto the closed roof. If hot slag does come into contact with the enclosed roof, which is at room temperature, an explosion occurs. Another pouring parameter that is unique to a closed tilting vessel is the heel weight. Usually, a vessel worker chooses the heel weight necessary for the next pour. The preferred method can then compare this preferred heel weight with the real-time heel weight indicated by the preferred method. Once the two values match, the vessel operator knows to shut down the pour and recharge. Achieving the proper heel is beneficial in that less heat is needed to heat the next batch than would have been necessary if the heel weight was to low. Moreover, if too much heel is kept, then less liquid metal is actually poured, thus decreasing the metal yield.

In another preferred method of the current invention, the metal yield from a tilting vessel can be improved by knowing the age of the tap hole and the tilt angle. During a typical run, the operator initiates the pour by tilting the vessel to a predetermined tilt angle, either indicated by a vessel worker or a computer database. Once the pour begins, the preferred process is activated. The tilt angle of the tilting vessel is measured while discharging liquid metal from the submerged tap hole into the second vessel. Measuring devices include, but are not limited to, rotary capacitance sensors, inductive sensors, and DC servo motor sensors. The output from the tilt sensor is mathematically converted into an angle measuring the tilt of the vessel. Preferably, the determined tilt angle is delivered to the vessel operator through an alphanumerical display, a light emitting diode display, an analog gauge, or a computer screen. In addition, the age of the tap hole is determined by reference to the steel mill's computer database, a mechanical counter or any other suitable method. Based on the tilt angle and the age of the tap hole, the vessel operator determines a preferred tap angle with reference to a table or graph that correlates the age of the tap hole with a preferred tap angle. This table can be input into a computer database and retrieved for use in the disclosed methods. The operator then adjusts the tilt of the vessel by manually activating the tilting means until the tilt angle is approximately the same as the recommended tilt angle. Since the tilt angle is determined by the table, operator error is reduced by eliminating operator judgment.

In another preferred process of the current invention, the metal yield from a tilting vessel can be improved without the measurement of a tilt angle. An operator can improve the metal yield by knowing the value of one pouring parameter. These parameters include, but are not limited to, the proximity of the vessel contents to the lip of the vessel, the presence of vortexing, the presence of slag in the tapping stream and distortion in the tapping stream. For example, the operator can advance or move back the tilting vessel in order to minimize the distance between the vessel contents and the vessel lip without spilling slag over the side of the lip. In doing so, the operator has increased the amount of liquid bath over the tap hole, and thus improved metal yield. In addition, the operator can forward the tilting vessel if he is aware of vortex formation, slag in the tapping stream or distortion in the tapping stream. By forwarding the tilting vessel, the vortex is dissipated, thus improving metal yield by suppressing the formation of low head vortexes. This preferred process is particularly helpful in improving the metal yield without the need for large capital expenditures on a great number of sensors and a computer network. Therefore, this method is quite suitable for small steel mills with a small operating budget.

In another embodiment of the current invention, a method for preventing spillage of the contents of a tilting vessel having a submerged tap hole over the vessel lip. Once the vessel has been charged and heated, the tilting vessel lip is coated with slag by adjusting the tilt angle of the tilting vessel. The coating creates a dam for retaining liquid metal within the tilting vessel.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for improving metal yield by adjusting a tilt angle of a tilting vessel having a submerged tap hole, the method comprising:

a) measuring a tilt angle of a tilting vessel while discharging liquid metal from said tap hole into a second vessel;

b) determining a selected set of pouring parameters selected from the group consisting of:

i) the proximity of the tilting vessel contents to the vessel lip;

ii) the age of said tap hole;

iii) the amount of slag in said tilting vessel;

iv) the amount charged to said tilting vessel;

v) the amount of metal discharged into said second vessel;

vi) the amount of said tilting vessel contents;

vii) the inner geometry of said tilting vessel;

viii) the presence of slag in the tapping stream;

ix) the liquid head over said tap hole;

x) the tapping trajectory from at least one historical pour;

xi) the total tapping time from at least one historical pour;

xii) the elapsed discharge time;

xiii) the critical height of vortexing;

xiv) the final drain angle;

xv) the steel grade;

xvi) the steel chemistry;

xvii) the slag chemistry;

xviii) the temperature of said vessel contents;

xix) the throughput of liquid metal exiting said tap hole;

xx) the presence of vortexes;

xxi) the distortion of said tapping stream; and xxii) the size of the tap hole;

c) receiving a condition input for each pouring parameter in said selected set of pouring parameters; and d) adjusting said tilt angle of said tilting vessel in response to each condition input of said selected set of pouring parameters.

2. The method of claim 1 wherein said receiving step occurs at a processing location.

3. The method of claim 1 wherein said determining said proximity of said vessel contents to said vessel lip is selected from the group consisting of:

a) providing an operator with a video output encompassing said tilting vessel lip;

b) inspecting visually said tilting vessel contents and said tilting vessel lip; and c) determining said proximity with a sensor which provides an output which is mathematically related to said proximity.

4. The method of claim 1 wherein said determining said amount of metal discharge into said second vessel is selected from the group consisting of:

a) providing an operator with a video output encompassing a top view of said second vessel;

b) inspecting visually a top view of said second vessel; and c) determining said metal discharge with a sensor which provides an output which is mathematically related to said metal discharge.

5. The method of claim 1 wherein said determining said presence of slag in said tap hole is selected from the group consisting of:

a) providing a video output encompassing a side view of said tapping stream;

b) inspecting visually said tapping stream; and c) using a sensor which provides output related to the detection of said presence of slag.

6. The method of claim 1 further comprising archiving said condition input for each pouring parameter in said selected set of pouring parameters.

7. The method of claim 6 further comprising reviewing said archived condition input for each pouring parameter in said selected set of pouring parameters.

8. The method of claim 6 further comprising training an individual based on said archived condition input for each pouring parameter in said selected set of pouring parameters.

9. The method of claim 1 wherein said tilting vessel has an enclosed roof and said determining step comprises determining a selected set of pouring parameters selected from the group consisting of:

i) the proximity of the tilting vessel contents to the edge of the back wall of said tilting vessel;

ii) the age of said tap hole;

iii) the amount of slag in said tilting vessel;

iv) the amount of a tilting vessel bath;

v) the amount of metal discharged into said second vessel;

vi) the heel weight;

vii) the inner geometry of said tilting vessel;

viii) the presence of slag in the tapping stream;

ix) the liquid head over said tap hole;

x) the tapping trajectory from at least one historical pour;

xi) the total tapping time from at least one historical pour;

xii) the elapsed discharge time;

xiii) the critical height of vortexing;

xiv) the final drain angle;

xv) the steel grade;

xvi) the steel chemistry;

xvii) the slag chemistry;

xviii) the temperature of said vessel contents;

xix) the throughput of liquid metal exiting said tap hole; and xx) the distortion of said tapping stream.

10. An apparatus for improving metal yield by adjusting a tilt angle of a tilting vessel having a submerged tap hole, the apparatus comprising:

a) a tilting vessel having a submerged tap hole;

b) a second vessel for receiving liquid metal from said submerged tap hole of said tilting furnace;

c) a tilt measuring device for measuring a tilt angle of said tilting vessel while discharging liquid metal from said tap hole into said second vessel;

d) an implement for determining a selected set of pouring parameters selected from the group consisting of:

i) the proximity of the tilting vessel contents to the vessel lip;

ii) the age of said tap hole;

iii) the amount of slag in said tilting vessel;

iv) the amount of a tilting vessel bath;

v) the amount of metal discharged into said second vessel;

vi) the amount of said tilting vessel contents;

vii) the inner geometry of said tilting vessel;

viii) the presence of slag in the tapping stream;

ix) the liquid head over said tap hole;

x) the tapping trajectory from at least one historical pour;

xi) the total tapping time from at least one historical pour;

xii) the elapsed discharge time;

xiii) the critical height of vortexing;

xiv) the final drain angle;

xv) the steel grade;

xvi) the steel chemistry;

xvii) the slag chemistry;

xviii) the temperature of said vessel contents;

xix) the throughput of liquid metal exiting said tap hole;

xx) the presence of vortexes;

xxi) the distortion of said tapping stream; and xxii) the size of the tap hole.

e) a process location for receiving a condition input for each pouring parameter in said selected set of pouring parameters; and f) a vessel tilt adjuster for adjusting said tilt angle of said tilting vessel in response to each condition input of said selected set of pouring parameters.

11. A method for improving metal yield by adjusting a tilt angle of a tilting vessel having a submerged tap hole, the method comprising:

a) determining a proximity of said tilting vessel contents to said tilting vessel lip; and b) adjusting a tilt angle of said tilting vessel in response to said proximity of said tilting vessel contents to the titling vessel lip.

12. A method for improving metal yield by adjusting a tilt angle of a tilting vessel having a submerged tap hole, the method comprising:

a) determining the presence of slag in the tapping stream; and b) adjusting a tilt angle of said tilting vessel in response to said presence of slag in the tapping stream.

13. A method for improving metal yield by adjusting a tilting angle of a tilting vessel having a submerged tap hole, the method comprising:

a) determining the presence of vortexes; and b) adjusting a tilting angle of said tilting vessel in response to said presence of vortexes.

14. The method of claim 11 further comprising measuring a tilt angle of said tilting vessel while discharging liquid metal from said tap into a second vessel.

15. A method for improving metal yield by monitoring the heel weight of a closed tilting vessel having a submerged tap hole, the method comprising:

a) determining the amount of metal discharged into a second vessel;

b) determining the amount of said closed tilting vessel contents based said amount of metal discharged into said second vessel;

c) determining an actual heel weight based on said amount of said tilting vessel contents;

d) determining a selected set of pouring parameters selected from the group consisting of:

i) the age of said tap hole;

ii) the amount of slag in said tilting vessel;

iii) the amount charged to said tilting vessel;

iv) the amount of metal discharged into said second vessel;

v) the amount of said tilting vessel contents;

vi) the inner geometry of said tilting vessel;

vii) the presence of slag in the tapping stream;

viii) the liquid head over said tap hole;

ix) the tapping trajectory from at least one historical pour;

x) the total tapping time from at least one historical pour;

xi) the elapsed discharge time;
xii) the critical height of vortexing;
xiii) the final drain angle;
xiv) the steel grade;
xv) the steel chemistry;
xvi) the slag chemistry;
xvii) the temperature of said vessel contents;
xviii) the throughput of liquid metal exiting said tap hole;
xix) the presence of vortexes;
xx) the distortion of said tapping stream; and
xxi) the size of the tap hole;

e) receiving a condition input for each pouring parameter in said selected set of pouring parameters;

f) determining an ideal heel weight based on each condition input of said selected set of pouring parameters;

g) determining a deviation by comparing said ideal heel weight with said actual heel weight; and h) adjusting the amount charged to said closed tilting vessel in at least one subsequent pour based on said deviation.

16. The method of claim 15 wherein said determining said amount of said tilting vessel contents comprises:

a) determining the elapsed discharge time;

b) determining the throughput of liquid metal exiting said tap hole; and c) determining the amount of said tilting vessel contents based said amount of metal discharged into said second vessel, said elapsed discharge time, and said throughput of liquid metal exiting said tap hole.

17. The method of claim 15 wherein said determining said amount of said tilting vessel contents comprises:

a) determining the amount of metal discharged into said second vessel; and b) determining the amount of said tilting vessel contents based said amount of metal discharged into said second vessel and said amount of metal discharged into said second vessel.

18. A method for improving metal yield by adjusting a tilt angle of a tilting vessel having a submerged tap hole, the method comprising:

a) measuring a tilt angle of said tilting vessel while discharging liquid metal from said tap into a second vessel;

b) determining an age of said tap hole of said tilting vessel; and c) adjusting said tilt angle of said tilting vessel in response to said age of said tap hole of said tilting furnace.

19. The method of claim 18 wherein said determining said age of said tap hole of said tilting vessel is selected from the group consisting of:

a) referring to a value stored in persistent memory of a computer;

b) generating a value from a mechanical counter; and c) counting the number of pours manually.

20. A method for improving metal yield by adjusting a tilt angle of a tilting vessel having a submerged tap hole, the method comprising:

a) measuring a tilt angle of said tilting vessel while discharging liquid metal from said tap into a second vessel;

b) determining a tapping trajectory from at least one historical pour; and c) adjusting said tilt angle of said tilting vessel in response to said age of said tap hole of said tilting furnace.

21. A method for determining a final drain angle for a tilting vessel having a submerged tap hole, the method comprising:

a) measuring a lining geometry of a tilting vessel; and b) determining a final drain angle of said tilting vessel based on said lining geometry of said tilting vessel.

22. The method of claim 22 wherein said lining geometry is provided by laser readings.

23. A method for determining a critical height of vortexing for a tilting vessel having a submerged tap hole, the method comprising:

a) determining the inner geometry of a tilting vessel;

b) determining the amount of metal discharged into a second vessel;

c) determining the amount charged to said tilting vessel;

d) determining the volume of the vessel contents based on said amount of metal discharged into said second vessel and said amount charged to said tilting vessel;

e) determining the size of the tap hole of said tilting vessel; and f) determining the critical height of vortexing based on said volume of said contents, said inner geometry and said size of the tap hole.

24. A computer-implemented method for improving metal yield by adjusting a tilt angle of a tilting vessel having a submerged tap hole, the method comprising:

a) receiving a tilt angle of a tilting vessel while discharging liquid metal from said tap hole into a second vessel;

b) generating a selected set of pouring parameters selected from the group consisting of:
i) the proximity of the vessel contents to the vessel lip;
ii) the age of said tap hole;
iii) the amount of slag in said tilting vessel;
iv) the amount of a vessel charge;
v) the amount of metal discharged into said second vessel;
vi) the amount of said vessel contents;
vii) the inner geometry of said tilting vessel;
viii) the presence of slag in said tap hole;
ix) the liquid head over said tap hole;
x) the tapping trajectory from at least one historical pour;
xi) the total tapping time from at least one historical pour;
xii) the elapsed discharge time;
xiii) the critical height of vortexing;
xiv) the final drain angle;
xv) the steel grade;
xvi) the steel chemistry;
xvii) the slag chemistry;
xviii) the temperature of said vessel contents;
xix) the rate of liquid metal flowing through said tap hole;
xx) the presence of vortexes;
xxi) the distortion of said tapping stream; and
xxii) the size of the tap hole;

c) receiving a condition input for each pouring parameter in said selected set of pouring parameters at a processing location; and d) adjusting said tilt angle of said tilting vessel in response to each condition input of said selected set of pouring parameters.

25. The computer-implemented method of claim 24 further comprising storing the condition input for each pouring parameter in said selected set of pouring parameters in persistent storage for subsequent retrieval.

26. The computer-implemented method of claim 24 further comprising predicting a tapping trajectory based on each condition input of said selected set of pouring parameters.

27. The computer-implemented method of claim 24 wherein said predicting step employs at least one of the following algorithms selected from the group consisting of:

a) a self-learning algorithm;

b) a neural net; and c) a fuzzy logic algorithm.

28. The computer-implemented method of claim 24 further comprising predicting a tapping duration based on each condition input of said selected set of pouring parameters.

* * * * *